United States Patent [19]

Gassner et al.

[11] Patent Number: 4,741,467

[45] Date of Patent: May 3, 1988

[54] EXPLOSIVE POWDER CHARGE OPERATED FASTENING MEMBER DRIVING TOOL

[75] Inventors: Theo Gassner, Triesenberg; Peter Von Flue, Mauren, both of Liechtenstein

[73] Assignee: Hilti Aktiengesellschaft

[21] Appl. No.: 19,482

[22] Filed: Feb. 26, 1987

[30] Foreign Application Priority Data

Feb. 28, 1986 [DE] Fed. Rep. of Germany ..... 3606514

[51] Int. Cl.[4] ..... B25C 1/14; B25C 1/18

[52] U.S. Cl. ..... 227/8; 227/10; 227/120

[58] Field of Search ..... 227/8, 9, 10, 11, 120

[56] References Cited

U.S. PATENT DOCUMENTS 3,565,313 2/1971 Seghezzi et al. ..... 227/10
3,670,942 6/1972 Pomeroy ..... 227/10
3,923,225 12/1975 Maier et al. ..... 227/8
3,991,925 11/1976 Büchel ..... 227/10
4,051,990 10/1977 Chromy et al. ..... 227/10

*Primary Examiner*—Paul A. Bell
*Attorney, Agent, or Firm*—Toren, McGeady & Associates

[57] ABSTRACT

An explosive powder charge operated fastening member driving tool has a muzzle part which can be locked within and released and removed from the tool housing by rotational movement and axial movement relative to the housing. When the tool is not ready to be fired, a contact pressure sensor projects from the front end of the muzzle part. By pressing the sensor opposite to the firing direction it compresses a firing mechanism spring and the tool is ready to be fired. Stop elements are provided on the muzzle part and stop surfaces are located on the tool housing. When the muzzle part is in the unlocked condition, the stop elements can abut the stop surfaces and block the displacement of the contact pressure sensor preventing it from compressing the firing spring mechanism so that the driving tool cannot be placed in the ready-to-fire condition.

11 Claims, 4 Drawing Sheets

EXPLOSIVE POWDER CHARGE OPERATED FASTENING MEMBER DRIVING TOOL

BACKGROUND OF THE INVENTION

The present invention is directed to an explosive powder charge operated fastening element driving tool including a housing with a handle projecting from its rear end. A firing mechanism having a cocking spring is located in the rear part of the housing with a muzzle part having a non-circular circumferential contour at its front part projecting in the firing direction out of the front end of the housing. The muzzle part is displaceable in the firing direction relative to the housing against retaining stops and displaceable in the opposite direction against stopping means. A contact pressure sensor is displaceably mounted relative to the muzzle part so that it can be displaced into a position for compressing the cocking spring whereby the tool is in the ready-to-fire condition. When the muzzle part is displaced in the rearward direction, the forward end of the contact pressure sensor is flush with the front end of the muzzle part and the driving tool is ready to be fired.

Nails or similar fastening members are driven at high speed into a hard receiving material, such as concrete or steel, by means of an explosive powder charge operated fastening member driving tools. For safety reasons, such driving tools incorporate contact pressure members which permit the firing of the driving tool only when the front end of its muzzle part is pressed against the surface of the receiving material.

In a driving tool, as disclosed in DE-AS No. 16 03 841, the contact pressure member is a tube-shaped contact pressure sensor displaceably supported in the muzzle part. When the driving tool is not in the firing condition, the sensor projects forwardly in the driving direction beyond the front end face of the muzzle part. The muzzle part has a central bore concentric with the driving axis. A guide bushing or barrel for a drive piston contacts the rear end face of the contact sensor and the barrel is biased in the driving or firing direction by a cocking spring in a firing mechanism. The barrel is displaceably supported in a housing and when the sensor is pressed rearwardly, it biases the barrel in the rearward direction which, in turn, compresses the cocking spring into the ready-to-fire condition.

The muzzle part is supported in the housing so that it can be displaced in the axial direction to a limited extent, but is not rotatable. To limit the movement of the muzzle part in the driving direction, retaining stops are provided to contact one another and to limit the movement in the opposite direction, stop means cooperate with one another which are provided on the muzzle part and on the housing. The installation of the muzzle part in the specific rotational position requires auxiliary tools and considerable installation effort. Accordingly, the removal and replacement of the muzzle part for changing the driving piston, is very cumbersome.

Driving fastening members into narrow rail sections or the placement of such members near or along a wall, requires a non-circular circumferential contour of the muzzle adjacent to its front end. A handle extending sidewise from the housing is in a specific rotational position relative to the non-circular muzzle portion.

Such an arrangement frequently results in handling problems when the driving tool is used, with the handle located so close to the wall when the driving operation is carried out, that satisfactory gripping of the handle and effective guidance of the driving tool is not possible.

SUMMARY OF THE INVENTION

Therefore, the primary object of the present invention is to provide an explosive powder charge operated fastening member driving tool with a handle projecting laterally outwardly from the housing, a muzzle part extending from the housing with a contact pressure device incorporating a contact pressure sensor displaceable relative to the muzzle part. The tool is arranged to permit rapid replacement of the muzzle part without the use of any auxiliary tools and it also permits satisfactory gripping of the tool in different utilization positions.

In accordance with the present invention, the muzzle part is rotatable about the bore axis of the muzzle part relative to the housing and it is also axially displaceable. Stop means on the muzzle part and the housing limit movement in the firing direction. A stop element projecting transversely of the firing direction is located in the path between stop surfaces forming stop means. The stop surfaces have circumferentially extending recesses into which the stop elements can be displaced for firing the tool. In addition, shoulders are provided on the muzzle part spaced rearwardly from counter-shoulders incorporated in the housing. When the tool is in the firing condition, the shoulders on the muzzle part are spaced from the counter-shoulders by a distance corresponding at least to the insertion movement of the stop elements into the recesses when the shoulders and the counter-shoulders are in registration in the axial direction of the muzzle part bore. By rotating the muzzle part relative to the housing when the stop elements are located within the recesses, it is possible to position the handle so that the tool can be used in a variety of difficult positions. The rotatability of the muzzle part, which is also axially displaceable to a limited extent in the housing, is afforded by the angular extent of the recesses formed in the stop surfaces with the angular extent being greater than the corresponding dimension of the stop elements. With the symmetrically paired arrangement of the stop means and the retaining stops, the muzzle part, while locked in the housing, can be rotated by half a turn. To achieve its locked position, the muzzle part is slid into the housing opposite the firing direction with the recesses located in alignment with the stop elements. Accordingly, the stop elements can move into the receiving recesses while the muzzle part is being inserted so that it can reach its rearward position until the stop means on the muzzle part and the housing contact one another and prevent any further insertion. In the rearward position of the muzzle part, the retaining stops formed by the shoulders on the muzzle part and the counter-shoulders in the housing are spaced apart in the firing direction at least by the amount that the stop elements are displaceable into the receiving recesses when the stop elements are aligned with the receiving recesses.

By pressing the front end of the muzzle part against a hard receiving material, the contact pressure sensor is displaced rearwardly, opposite to the firing direction, the cocking spring of the firing mechanism is compressed and the tool is in the firing condition. In the firing condition, the front end face of the contact pressure sensor flush with the front end face of the muzzle part when it is displaced into its rearward position.

To remove the muzzle part, the shoulders on the muzzle part and the counter-shoulders on the housing or locks are moved out of axial registration with one another and the muzzle part can be pulled in the firing direction out of the housing. If the muzzle part is not removed from the housing and the shoulders and counter-shoulders are rotationally displaced out of registration with one another, it is not possible to move the muzzle part into the rearward position required for the firing condition, since the stop elements abut against the stop surface in which the receiving recesses are formed. With the shoulders out of registration, the stop elements cannot be moved into the receiving recesses. In the unlocked rotated position of the muzzle part, it is not possible to displace the contact pressure sensor opposite to the firing direction for placing the tool in the ready-to-fire condition.

Preferably, the receiving recesses are located in a circumferentially extending surface of the housing and the stop elements on the muzzle part. Cams or pin-like members can be used as stop elements and the stop elements can be replaceably fixed to the body of the muzzle part.

To provide sufficient rotatability of the muzzle part relative to the housing, for effective use of the driving tool under different conditions, the angular dimension of the receiving recesses can be in the range of two to five times greater than the corresponding dimension of the outside surface of the stop elements.

Another feature of the invention is to provide the shoulders on the muzzle part by a surface facing in the firing direction on a portion of the muzzle part located within the front end of the housing and adjacent to a counter-shoulder facing opposite to the firing direction. The counter-shoulders can be formed by a rear axial part of recesses, basically sickle-shaped in cross-section, and arranged as an axially projection of the stop elements.

Preferably, the counter-shoulders in the housing are formed as end face surfaces of locks directed opposite to the firing direction. The locks are radially engaged within a shaped recess in the outer surface of the stub of the muzzle part which fits into the housing. The locks can be held in a stationary position in the housing or in a receiving member in the housing with limited displaceability so that they can be displaced perpendicularly to the driving direction or axis.

To achieve automatic engagement, the locks are pressed radially inwardly by spring means against the outer surface of the stub portion of the muzzle part inserted into the housing.

To remove the muzzle part from the housing, the shoulders and counter-shoulders in registration with one another in the locked position of the muzzle part must be rotatably displaced out of registration. The unlocking movement of the muzzle part is effected by disengaging the locks and, in a preferred embodiment, the locks are in the form of control cams mounted about the muzzle part on the stub or portion which extend into the front end of the housing. The locks are located spaced ahead of the shoulder provided in the outer surface of the stub portion of the muzzle part. Disengagement of the locks is possible by a partial rotation of the muzzle part after axially movement of the muzzle part for removing the stop elements out of the receiving recesses. In the rotationally displaced position, the locks contact the rounded outside surface of the stub portion of the muzzle part whereby the muzzle part can be pulled out of the housing in the firing or driving direction.

The control cam can be formed by the bottom surfaces of sickle-shaped recess in the muzzle part. With the bottom of the recesses forming a transition into the rounded circumferential contour of the stub portion of the muzzle part in the circumferential direction, the muzzle part can be rotated by overcoming a spring action. The spring action is formed by an annular-spring member which biases the locks radially inwardly against the muzzle part. Accordingly, the muzzle part cannot rotate from the locked into the unlocked position without overcoming the spring action.

To attain a rotational snap-in in different rotational positions in the range of the rotatability of the locked muzzle part, the control cams can be subdivided in the circumferential direction into planar surfaced sections. The locks, spring biased against the control cams, abut with a preferably planar contact face against one of the planar surfaced sections. By rotating the muzzle part against the biasing action of the spring means, the locks can be displaced out of locking engagement.

In another feature of the invention, the rear end of the muzzle part extending into the housing has a surface tapering inwardly opposite to the firing direction for aiding in the radially disengagement of the locks. The tapering surfaces are provided by insertion faces which merge at a position spaced from the rear end of muzzle part into the round circumferential contour of the outer surface of the muzzle part within the housing. This arrangement greatly simplifies the insertion and locking of the muzzle part. By means of the tapered arrangement of the insertion faces, the locks are radially displaced toward the rounded circumferential surface of the muzzle part as the muzzle part is inserted into the front end of the housing in the direction opposite to the driving direction and against the force of the spring means inwardly biasing the locks which press the locks inwardly against the control cam surfaces on the outer surface of the muzzle part.

In yet another feature of the invention, the muzzle part has an opening extending from the outside into the muzzle bore forming a passageway for moving fastening elements into the muzzle bore. The fastening elements are located in a hollow section extending generally radially outwardly from the muzzle part and the hollow section serves as a handle for locking and unlocking the muzzle part and for positioning the muzzle part rotatably in the locked position. In this arrangement, the contact pressure sensor is in the form of an elongated pin mounted in the outer surface of the muzzle part radially offset from the axis of the muzzle part bore. The contact pressure sensor can be displaced in the rearward direction into a position where the driving tool is in the ready-to-fire condition. The displacement of the sensor is effected by pressing its front end against the receiving material into which the fastening element is to be driven. As the contact pressure sensor moves rearwardly it compresses the cocking spring of the firing mechanism with the sensor acting against the front end of the barrel in which the driving piston is located.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
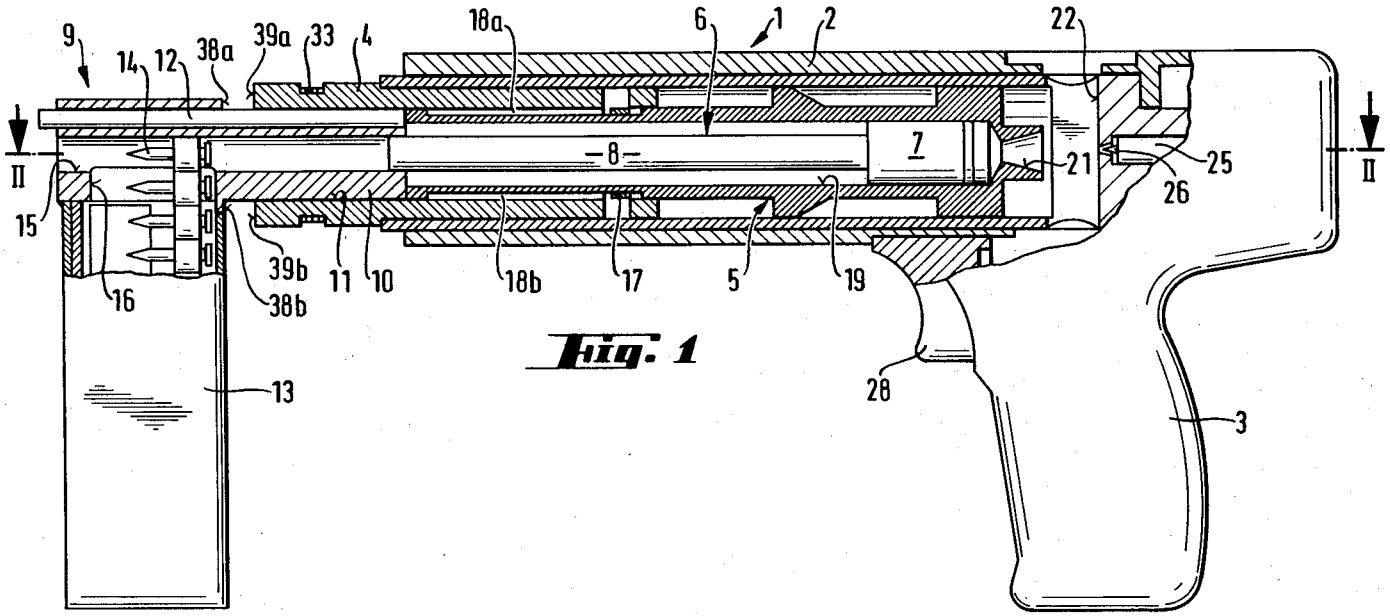
FIG. 1 is a side elevational view of a fastening element driving tool, partly in axially extending section and with the tool out of the ready-to-fire condition.
Figure 2:
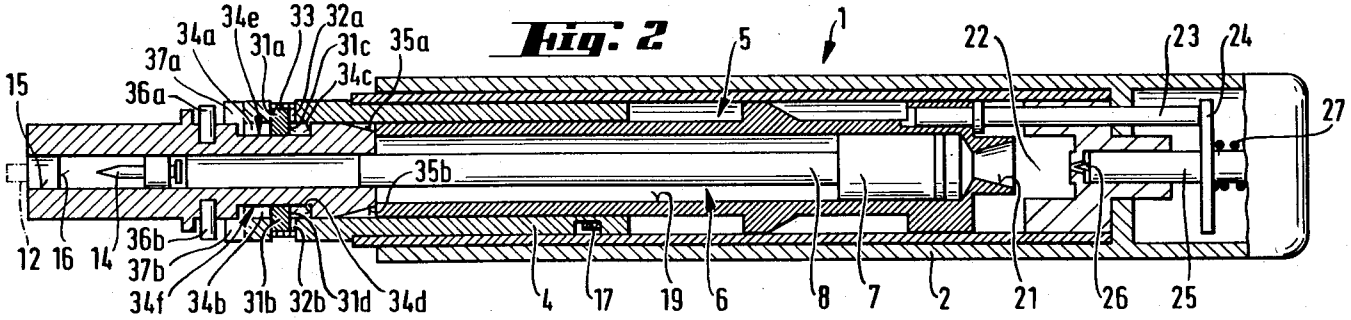
FIG. 2 is a cross-sectional view through the driving tool in FIG. 1, taken along the line II—II.

In FIGS. 1 and 2, an explosive powder charge operated fastening member driving tool is shown in the non-firing condition; that is, it is not ready to be fired. The driving tool comprises a housing 1 having a front end on the left-hand part of FIGS. 1 and 2, and a rear end in the right-hand part. Similarly, the other parts or components forming the tool have a front end to the left and a rear end to the right. The driving or firing direction of the tool is from the right to left. Housing 1 includes a housing body 2 with a handle 3 formed on and extending downwardly from the rear part of the housing. A tubular receiving member 4 forms a part of the housing with the front part of receiving member 4 projecting outwardly from the housing body 2 and a rear part extending inwardly into the front part of the housing body. In the rear part of the housing body 2, there is a firing mechanism, however, it is only partly illustrated. The firing mechanism is a known device. Within the front part of the housing 1, within the housing body 2, there is an axially-extending guide bushing or barrel 5 which is axially displaced relative to the housing body. A driving piston 6 is located within the barrel 5 and has a head 7 in sliding contact with the surface of the bore formed within the barrel. An axially-extending shank 8 extends from the front end of the head 1 through the barrel spaced inwardly from the surface of the bore and its front end projects into a muzzle part 9. Muzzle part 9 has an axially-extending rear part or stub 10 axially slidably displaceable within a receiving bore 11 in the receiving member 4 of the housing 1. An axially extending pin-like contact pressure sensor 12 extends from the front end to the rear end of the muzzle part 9, arranged parallel to the axis of the muzzle bore 15.

In the not-ready-to-fire condition of the driving tool, the contact pressure sensor 12 projects at its front end outwardly from the front end of the muzzle part 9, note FIG. 1, and its rear end is in surface contact with the front end of the barrel 5. The axially-extending portion of the muzzle part 9, projecting outwardly from the front end of the receiving member 4, has a circumferential contour which is out of round, that is, it is not circular, note FIG. 7. A magazine member 13 extends downwardly from the front portion of the muzzle part 9, and contains fastening elements 14 in the form of nails detachably connected together in a belt-like arrangement. A passageway or aperture 16 is located in the wall of the muzzle part 9 so that the fastening elements 14 can move into the muzzle bore 15 into position to be driven by the front end of the shank 8 of the driving piston 6, when an explosive powder charge is fired within the driving tool.

To connect the barrel 5 with the receiving member 4, with the barrel being axially displaceable to a limited extent relative to the receiving member, a circumferentially extending spring clip 17 is held in the receiving member so that it cannot move axially and projects into axially extending recesses 18*a* 18*b* in the outer surface of the barrel with the recesses being closed at the front end and the rear ends thereof. At the rear end of the barrel 5, there is a conically-shaped firing chamber 21 arranged to receive known explosive powder charges, not shown, such as cartridges. The firing chamber 21 opens at its front end to the rear end of a bore 19 within the barrel in which the head 7 of the driving piston is in sliding contact. The explosive powder charges are stored in a strip or belt form and are fed through a channel 22 extending transversely of the firing direction so that the charges can be inserted into the firing chamber. A cocking pin 23, note FIG. 2, is rigidly supported in the rear end of the barrel 5 and extends rearwardly from the barrel opposite to the firing direction and, at its rear end, bears against an entrainment bolt 24 of the firing mechanism with the bolt 24 extending transversely of the cocking pin.

Entrainment bolt 24 is fixed to an axially-extending firing pin 25 which is axially displaceably supported in the rear part of the housing, note FIG. 2, and the front end of the firing pin has a firing tip 26 in axial alignment with the firing chamber 21. A cocking spring 27 extends around the rear part of the firing pin 25, and stores the energy when the entrainment bolt 24 compresses the spring for biasing the firing pin 25 in the firing direction against an explosive powder charge within the firing chamber.

Figure 3:
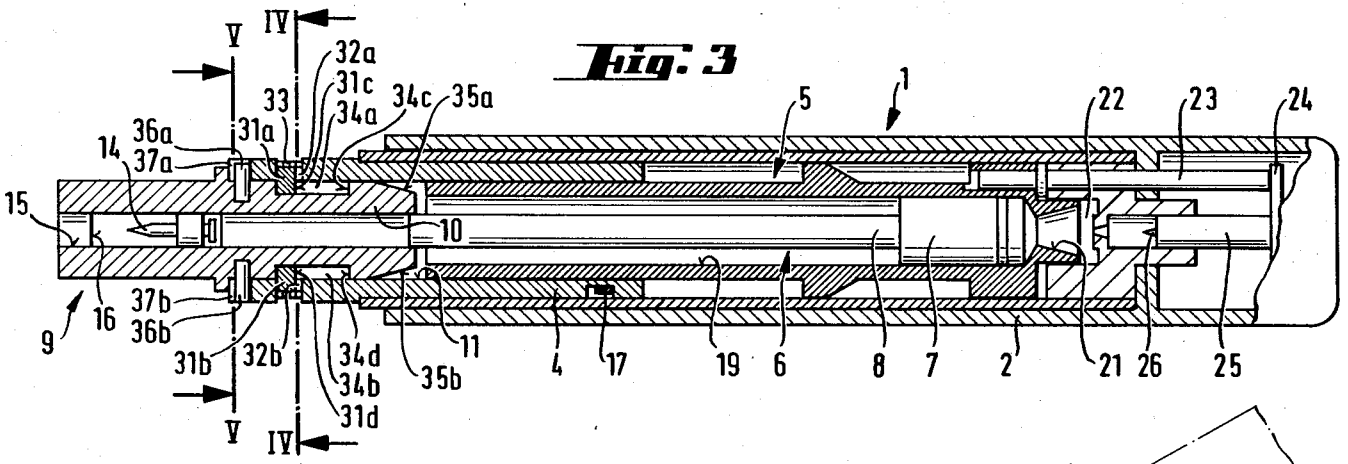
FIG. 3 is a sectional view similar to FIG. 2, however, with the driving tool in the ready-to-fire condition.

The firing mechanism is cocked by sliding the barrel 5 from the position shown in FIGS. 1 and 2 into the ready-to-fire condition shown in FIG. 3. As the cocking pin 23 is moved rearwardly by the barrel 5, it acts against the force of the cocking spring 27. To fire the driving tool, firing pin 25 is rotated slightly about its axis in a known manner by actuating a trigger 28 located in the handle 3, so that the entrainment bolt is moved out of the effective range of the cocking pin and the firing pin is driven forwardly by the spring 27 against the explosive powder charge located within the firing chamber. When ignited, the explosive powder charge drives the piston 6 through the barrel with the front end of its shank 8 moving forwardly into contact with a fastening element 14, and driving the fastening element into a receiving material.

Locking the muzzle part 9 in the receiving body 4 is effected by a pair of segment-like locks 31*a*, 31*b*, supported in windows 32*a*, 32*b* of the receiving body so that the locks extend through the windows into locking contact with the muzzle part. The locks 31*a*, 31*b* are radially displaceable between a locking position and an unlocking position. In the locked position, the locks 31*a*, 31*b* are engaged by an annular spring 33 which biases the locks radially inwardly into recesses 34*a*, 34*b* on opposite sides of the muzzle part 9. The recesses 34*a*, 34*b* are limited in the axial direction of the muzzle part.

Figure 4:
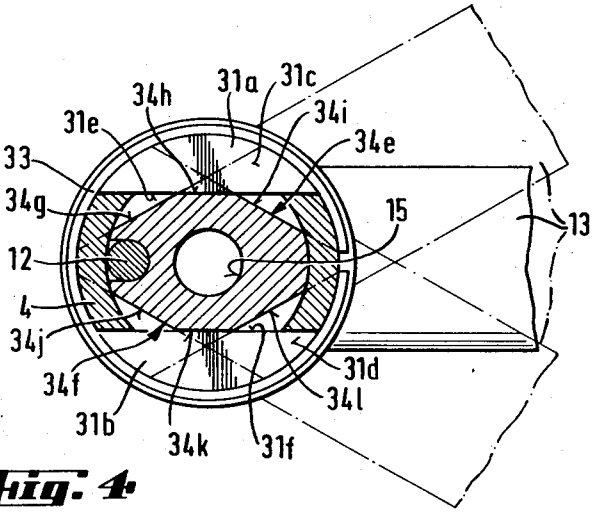
FIG. 4 is an enlarged cross-sectional view of the driving tool taken along the line IV—IV in FIG. 3.
Figure 7:
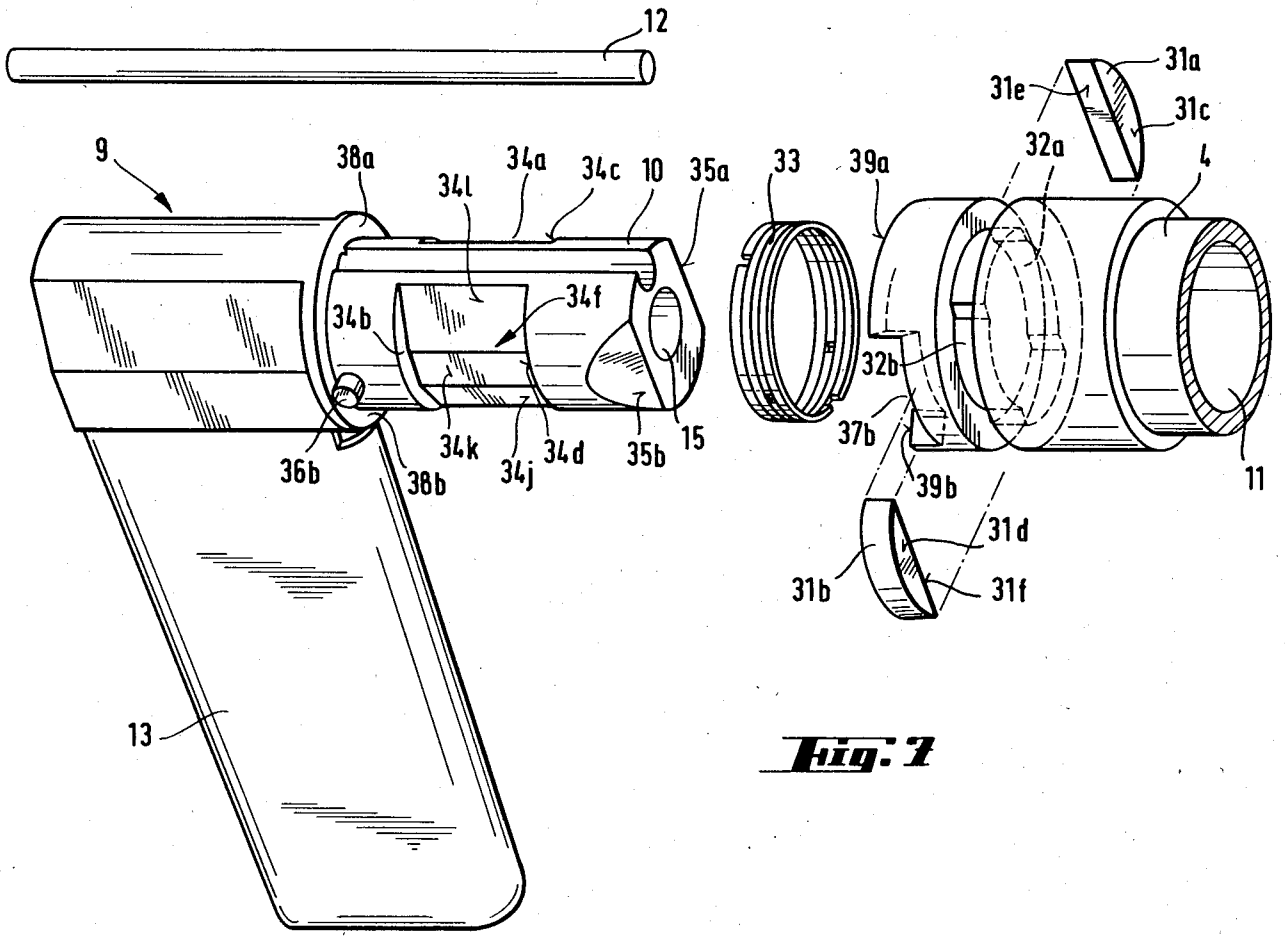
FIG. 7 is an exploded prospective view of the muzzle part and of the front end parts of the housing.

As can be seen in FIG. 4 and FIG. 7, the locks 31*a*, 31*b* have planar surfaces facing in the opposite axial directions of the muzzle bore and a flat planar surface extends in the axial direction with the ends of the flat planar surface interconnected by an arcuate surface. The flat planar surfaces are located radially inwardly so that they extend through the windows 32*a*, 32*b* into contact with the muzzle part 9. Muzzle part 9 has the recesses 34*a*, 34*b* located within its rear part or stub 10. The rear part 10 outside the region of the recesses 34*a*, 34*b*, has a rounded circumferential contour corresponding to the receiving bore 11 in the receiving body 4. The axially-spaced ends of the recesses 34*a*, 34*b* form shoulders 34*c*, 34*d* in axial registration with the counter-shoulders 31*c*, 31*d* on the locks, that is, the planar sides of the segment-shaped locks extending transversely of the bore axis of the muzzle part 9. Shoulders 34*c*, 34*d* serve, in combination with the counter-shoulders 31*c*, 31*d*, as retention stops limiting the displacement or movement of the muzzle part toward the front of the driving tool when the locks are in the locked position.

In the rotational direction of the muzzle part 9, about the axis of its bore, the base of each recess 34*a*, 34*b* has a control cam 34*e*, 34*f*, which extends between the rounded circumferential contour of the muzzle part. The control cams 34*e*, 34*f* can be seen best in FIG. 4 where each cam is made up of a plurality of circumferentially extending planar surfaces 34*g*, 34*h*, 34*i* for cam 34*e* and 34*j*, 34*k* and 34*l* for cam 34*f*. In the locked position the locks 31*a*, 31*b* are each located in one of the recesses 34*a*, 34*b* and are biased radially inwardly by the annular spring 33 into contact with the cams 31*e*, 31*f*, respectively. To turn or rotate the muzzle part about its bore axis, relative to the housing 1, it is necessary to overcome the biasing action of the spring 33 for the movement as suggested by the dash-dot lines indicating the different rotational positions of the handle-like magazine 13 within the locked position.

If the muzzle part is rotated passed the dash-dot positions shown in FIG. 4, the locks are urged by the control cams 34*e*, 34*f* out of the recesses 34*a*, 34*b* into contact with the rounded circumferential contour of the rear part 10 of the muzzle part. In such a rotated position, the muzzle part can be withdrawn out of the receiving member 4 in the forward or firing direction. The insertion of the muzzle part into the receiving member 4, is effected by sliding it into the housing and insertion surfaces 35*a*, 35*b* at the rear end of the muzzle part 9 diverge outwardly on opposite sides of the muzzle part to the rounded circumferential surface of the muzzle part. During insertion, the insertion surfaces 35*a*, 35*b* contact the inner surfaces of the locks 31*a*, 31*b*, so that the radially inner surfaces of the locks ride on the rounded circumferential surface of the muzzle part and then into the recesses 34*a*, 34*b*.

Figure 5:
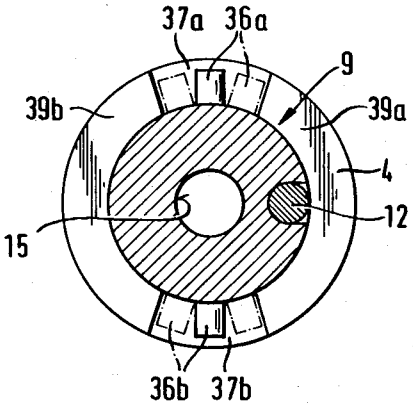
FIG. 5 is an enlarged cross-sectional view of the driving tool taken along the line V—V in FIG. 3.

For safety reasons, the actuation of the driving tool for the insertion of a fastening member is possible only when the muzzle is in the locked position. In the rotated unlocked position of the muzzle part, the contact pressure sensor 12 which displaces the barrel 5 into the ready-to-fire condition cannot be moved in the rearward direction opposite the firing direction a sufficient amount. To prevent the firing of the tool, the muzzle part 9 has a pair of oppositely-located stop elements 36*a*, 36*b* in the form of pins or cams. In the locked position of the muzzle part, when it is displaced in the rearward direction as shown in FIG. 3, as compared to the position in FIG. 2, each stop element moves into a receiving recess 37*a*, 37*b* in the front surfaces 39*a*, 39*b*, located at the front end of the receiving member 4. When the muzzle part 9 is displaced rearwardly as shown in FIG. 3, it can be rotated about its bore axis to the extent that the stop elements 36*a*, 36*b* can move in the circumferential direction of the tool within the receiving recesses 37*a*, 37*b*. In FIG. 5, the different rotated positions of the stop elements 36*a*, 36*b* within the recesses 37*a*, 37*b* are shown in dash-dot lines. This rotational travel corresponds to the extent of the axial registration of the counter-shoulders 31*c*, 31*d* on the stops 31*a*, 31*b* with the shoulders 34*c*, 34*d* located within the recesses 34*a*, 34*b*.

The rearward movement of the muzzle part 9 is limited by stop means formed by the rearwardly facing surfaces 38*a*, 38*b* on an annular shaped end face of the muzzle part 9 facing opposite to the firing direction and the cooperating surfaces 39*a*, 39*b* on an annular shaped end face at the front end of the receiving member 4, note FIG. 1 and FIG. 7. When the front end of the muzzle part 9 is pressed against the surface of the receiving material 41, note FIG. 6, the contact pressure sensor is moved rearwardly into the ready-to-fire condition by the axial extent of its projection outwardly from the front end of the muzzle part 9, as shown in FIG. 1, along with the movement of the muzzle part in the axial direction, opposite to the firing direction into the receiving member 4. As the contact pressure sensor 12 moves in the rearward direction of the tool, it moves the barrel 5 in the same direction opposite to the force of the cocking spring 27, so that the rearward movement compresses the spring for carrying out the firing operation.

To remove the muzzle part 9 from the housing 1, initially it must be pulled forwardly until the stop elements 36*a*, 36*b* are displaced in the forward or firing direction out of the recesses 37*a*, 37*b*. With the stop elements 36*a*, 36*b* located out of the recesses 37*a*, 37*b*, it is possible to rotate the muzzle part to disengage the locks 31*a*, 31*b*, so that the muzzle part is in the unlocked position. In this rotated position, the muzzle part can be pulled in the forward direction out of the housing.

Figure 6:
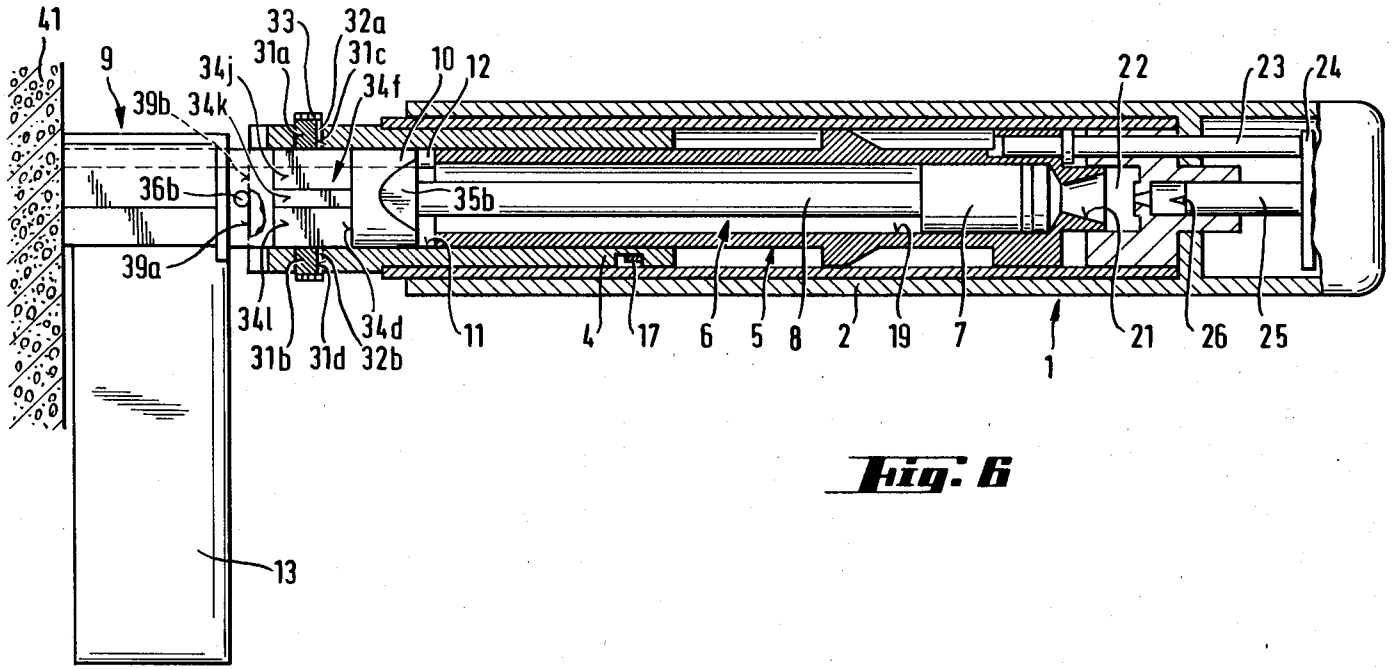
FIG. 6 is a sectional view similar to FIG. 2 with the muzzle part in the unlocked position within the driving tool and with the front end of the tool placed against a hard receiving material.

If the muzzle part 9 is rotated into the unlocked position and the driving tool is pressed at its front end, that is the front end of the muzzle part, against the receiving material 1, the stop elements 36*a*, 36*b*, having been rotated out of alignment with the recesses 37*a*, 37*b*, contact the surfaces 39*a*, 39*b* at the front end of the receiving member 4, note FIG. 6. Accordingly, with the driving tool pressed against the receiving material, the contact pressure sensor 12 can be moved rearwardly only by the amount that the sensor projects forwardly from the muzzle part, this projection can be noted in FIGS. 1 and 2. The complete rearward movement of the contact pressure sensor 12, into the ready-to-fire condition, is impossible, since the muzzle part 9, cannot move rearwardly due to the contact between the stop elements 36*a*, 36*b* with the surfaces 39*a*, 39*b*.

In the exploded view set forth in FIG. 7, the relationship of the various parts of the muzzle part 9, and the combination of the receiving member 4, the stops 31*a*, 31*b* and the spring 33 can be noted. Note that the handle-like magazine 13 at the front end of the muzzle part 9, and the non-circular circumferential surfaces of the front end of the muzzle part 9 permit its limited rotation for handling the driving tool in certain positions.

While specific embodiments of the invention have been shown and described in detail to illustrate the application of the inventive principles, it will be understood that the invention may be embodied otherwise without departing from such principles.

We claim:

1. Explosive powder charge operated fastening member driving tool comprising a housing having a firing direction in which fastening elements are driven from the tool, said housing having a front end leading in the firing direction and an oppositely facing rear end trailing in the firing direction, a handle extending outwardly from said housing transversely of the firing direction and located adjacent to the rear end of said housing, said housing including a tubular receiving member located within the front part of said housing, a muzzle part having a front end and a rear end spaced apart in the firing direction and having an axially-extending bore therethrough extending in the firing direction, said muzzle part being displaceable into said housing opposite to the firing direction in position for firing the driving tool, a rear part of said muzzle part located within said housing and a front part projecting in the firing direction out of the front end of said housing, the front part of said muzzle part having a non-circular outer circumferential surface, said muzzle part being displaceable within said housing in the firing direction between a retaining means and a stop means with the stop means trailing said retaining means in the firing direction, an elongated contact pressure sensor extending parallel to the firing direction and mounted in said muzzle part for displacement in the direction of the axis of the bore in said muzzle part between a first position projecting from the front end of said muzzle part and a second position flush with the front end of said muzzle part when the driving tool is ready to be fired, said sensor cocking a firing spring in the second position thereof, wherein the improvement comprises that said muzzle part is rotatable about the bore axis thereof relative to said housing, said stop means comprises a first stop surface on said muzzle part facing a second stop surface on said housing which second stop surface faces in the firing direction, a stop element on one of said housing and said muzzle part extending transversely of the firing direction and located in the path between a first stop surface and a second stop surface, one of said first and second stop surfaces having a circumferentially extending recess therein arranged to receive said stop element, said retaining means comprises a shoulder on said muzzle part and a counter-shoulder on said housing, said shoulder, when said muzzle part is in the position for firing the driving tool, is spaced in the axial direction of said bore axis from said counter-shoulder by a distance corresponding to the insertion movement in the bore axis direction of said stop element into said recess when said shoulder and counter-shoulder are in registration in the bore axis direction.

2. Explosive powder charge operated fastening member driving tool, as set forth in claim 1, wherein said circumferentially extending recess, is arranged in the housing, and said stop element is located on said muzzle part.

3. Explosive powder charge operated fastening member driving tool, as set forth in claim 2, wherein the dimension of said recess in the circumferential direction around the bore axis of said muzzle part is in the range of two to five times as great as the corresponding dimension of the outside surface of said stop element.

4. Explosive powder charge operated fastening member driving tool, as set forth in claim 1, wherein said shoulder on said muzzle part is located in the rear part of said muzzle part and faces in the firing direction and is spaced opposite to the firing direction from said first stop surface on said muzzle part.

5. Explosive powder charge operated fastening member driving tool, as set forth in claim 4, wherein said housing comprises a lock, said receiving member comprises a bore co-axial with said bore in said muzzle part, said lock projects radially through said receiving member into the bore therethrough into locking engagement with said rear part of said muzzle part.

6. Explosive powder charge operated fastening member driving tool, as set forth in claim 5, wherein the spring means located on said housing bias said lock radially inwardly into locking engagement with the rear part of said muzzle part.

7. Explosive powder charge operated fastening member driving tool, as set forth in claim 6, wherein said rear part of said muzzle part has a rounded circumferential surface extending in the axial direction of the muzzle part bore, a recess formed in said rounded circumferential surface extending in the axial direction and in the circumferential direction of said rear part of said muzzle part, the base of said recess forms a control cam for said lock, with said control cam recessed inwardly from said circumferential surface of said rear part and said shoulder formed by the end of said recess spaced more remotely from the front part of said muzzle part.

8. Explosive powder charge operated fastening member driving tool, as set forth in claim 7, wherein the end of said rear part of said muzzle part remote from the front part of said muzzle part and facing opposite to the firing direction has a tapered contour in the circumferential surface of said rear part with the tapered contour diverging outwardly in the firing direction for assisting in the insertion of said muzzle part into said housing.

9. Explosive powder charge operated fastening member driving tool, as set forth in claim 7, wherein a pair of said recesses each forming one of said control cams are located on diametrically opposite sides of the rear part of said muzzle part, said locks having a dimension in the firing direction considerably less than the dimension of said recesses in said muzzle part extending in the firing direction, each said control cams comprising a plurality of planar surfaces forming the base of said recess with said planar surfaces located along side one another extending in the firing direction and extending between the rounded circumferentially contour of said rear part of said muzzle part.

10. Explosive powder charge operated fastening member driving tool, as set forth in claim 1, wherein the front part of said muzzle part has an opening extending therethrough between the outside of said muzzle part and said muzzle bore, and a handle-like magazine secured to said front part of said muzzle part and aligned with the opening therethrough and arranged to hold fastening elements for movement from said magazine through the opening in said front part into said muzzle bore.

11. Explosive powder charge operated fastening member driving tool, as set forth in claim 1, wherein a pair of said stop elements are located diametrically opposite one another on said muzzle part, a pair of said circumferentially extending recesses formed in said housing part and selectively alignable with said stop elements, said muzzle part being rotatably about the axis of said muzzle part bore between a locked position where said muzzle part is locked within said housing and an unlocked position where said stop elements are displaced out of alignment with the said recesses so that said muzzle part can be withdrawn out of the front end of said housing.

* * * * *